US005855131A

United States Patent [19]

Schmid et al.

[11] Patent Number: 5,855,131

[45] Date of Patent: Jan. 5, 1999

[54] PROCESS AND DEVICE FOR INFLUENCING A PROFILE OF A ROLLED STRIP

[75] Inventors: Friedemann Schmid, Erlangen; Guenter Soergel, Nurenberg; Otto Gramckow, Erlangen, all of Germany

[73] Assignee: Siemens Aktiengesellschaft, München, Germany

[21] Appl. No.: 848,440

[22] Filed: May 8, 1997

[30] Foreign Application Priority Data

May 10, 1996 [DE] Germany ..... 196 18 995.0

[51] Int. Cl.[6] ..... B21B 37/28

[52] U.S. Cl. ..... 72/11.7; 72/9.5; 72/14.1; 72/201

[58] Field of Search ..... 72/9.5, 9.1, 10.1, 72/11.7, 12.1, 12.4, 13.4, 14.1, 200, 201, 342.3, 252.5, 236

[56] References Cited

U.S. PATENT DOCUMENTS

| | | | |
|---|---|---|---|
| 3,357,224 | 12/1967 | Muller | 72/342.3 |
| 4,706,480 | 11/1987 | Svatos | 72/17 |
| 4,912,955 | 4/1990 | Stines | 72/201 |
| 5,212,975 | 5/1993 | Ginzburg | 72/201 |
| 5,235,835 | 8/1993 | Sakai et al. | 72/201 |
| 5,517,842 | 5/1996 | Ginzburg | 72/201 |
| 5,553,469 | 9/1996 | Seidel | 72/13.4 |
| 5,651,281 | 7/1997 | Seidel | 72/201 |

FOREIGN PATENT DOCUMENTS

| | | |
|---|---|---|
| 34 25 129 | 1/1986 | Germany . |
| 39 43 093 | 7/1990 | Germany . |
| 54-62153 | 5/1979 | Japan . |
| 1031548 | 7/1983 | U.S.S.R. . |
| 1678479 | 9/1991 | U.S.S.R. . |

OTHER PUBLICATIONS

Friedmar, Unger et al. "Berechnugng der eforderlichen Kühl–und Schmiermittelverteilung zur Realisierung einter gegebenen Balligkeit von Kaltwalzen im stationären Arbeitszustand", *Neue Hütte,* 24, Jahrgang Heft. 1 (Jan. 1979), pp. 13–17.

*Primary Examiner*—Joseph J. Hail, III
*Assistant Examiner*—Ed Tolan
*Attorney, Agent, or Firm*—Kenyon & Kenyon

[57] ABSTRACT

Process and device for influencing the profile of a rolled strip in a roll stand by affecting the camber of the rolls, i.e., the surface geometry of the rolls in the longitudinal direction of the rolls. The camber of the rolls is affected by influencing the temperature profile of the rolls or their surface in the longitudinal direction of the rolls. In one embodiment, the temperature profile of the surfaces of the rolls is controlled by cooling the surfaces of the rolls.

25 Claims, 3 Drawing Sheets

PROCESS AND DEVICE FOR INFLUENCING A PROFILE OF A ROLLED STRIP

FIELD OF THE INVENTION

The present invention relates to a process and a device for influencing a profile of a rolled strip.

BACKGROUND INFORMATION

In addition to the thickness of the strip, the geometry of the cross section of the strip including the thickness profile and the relevant edge drop (i.e., the shape of the strip at the edge) are important parameters in determining the quality of the rolled profile. The geometry of the strip cross section can be influenced by the geometry of the rolls in the roll stand, i.e., the camber of the rolls. It is known that camber can be influenced mechanically, e.g., by moments, displacement or bending. This process is effective with CVC rolls or taper rolls. However, CVC rolls can only be preset in an unloaded state. Therefore, they are used exclusively for presetting. Furthermore, this process is extremely expensive and cost-intensive, and shortens the lifetime of a roll stand.

There is a need to provide a process and a device for carrying out this process that will make it easier to influence the geometry of a rolled strip.

SUMMARY OF THE INVENTION

The present invention meets this need with a process and a device for influencing relevant quality parameters, such as the profile and flatness of a rolled strip in a roll stand with rolls by adjusting the camber of the rolls (i.e., the surface geometry of the rolls along the longitudinal direction of the rolls). The camber of the rolls is affected by influencing the temperature profile of the rolls by cooling the rolls. Influencing the camber of rolls by cooling has proven advantageous in comparison with mechanical shaping of the roll surface. In the process according to the present invention, cooling of the camber is varied along the longitudinal (or axial) direction of the roll, so that individual areas of the rolls expand to a different extent in the longitudinal direction of the roll. This is suitably accomplished, for example, with a cooling device that can be controlled in segments along the longitudinal direction of the roll. The process can also be utilized to vary the temperature profile of the rolls by heating the rolls.

The quantity of coolant and application of a pattern of coolant provided to the rolls, i.e., work rolls and/or back up rolls, are preferably controlled as a function of a load time of the roll stand, a pause time between two rolled strips, a roll separating force and a temperature of the strip. These four variables have proven to be suitable parameters for adjusting the quantity of coolant and the method of application of coolant.

The process according to the present invention is particularly useful in presetting rolls to a desired state.

DETAILED DESCRIPTION

Figure 1:
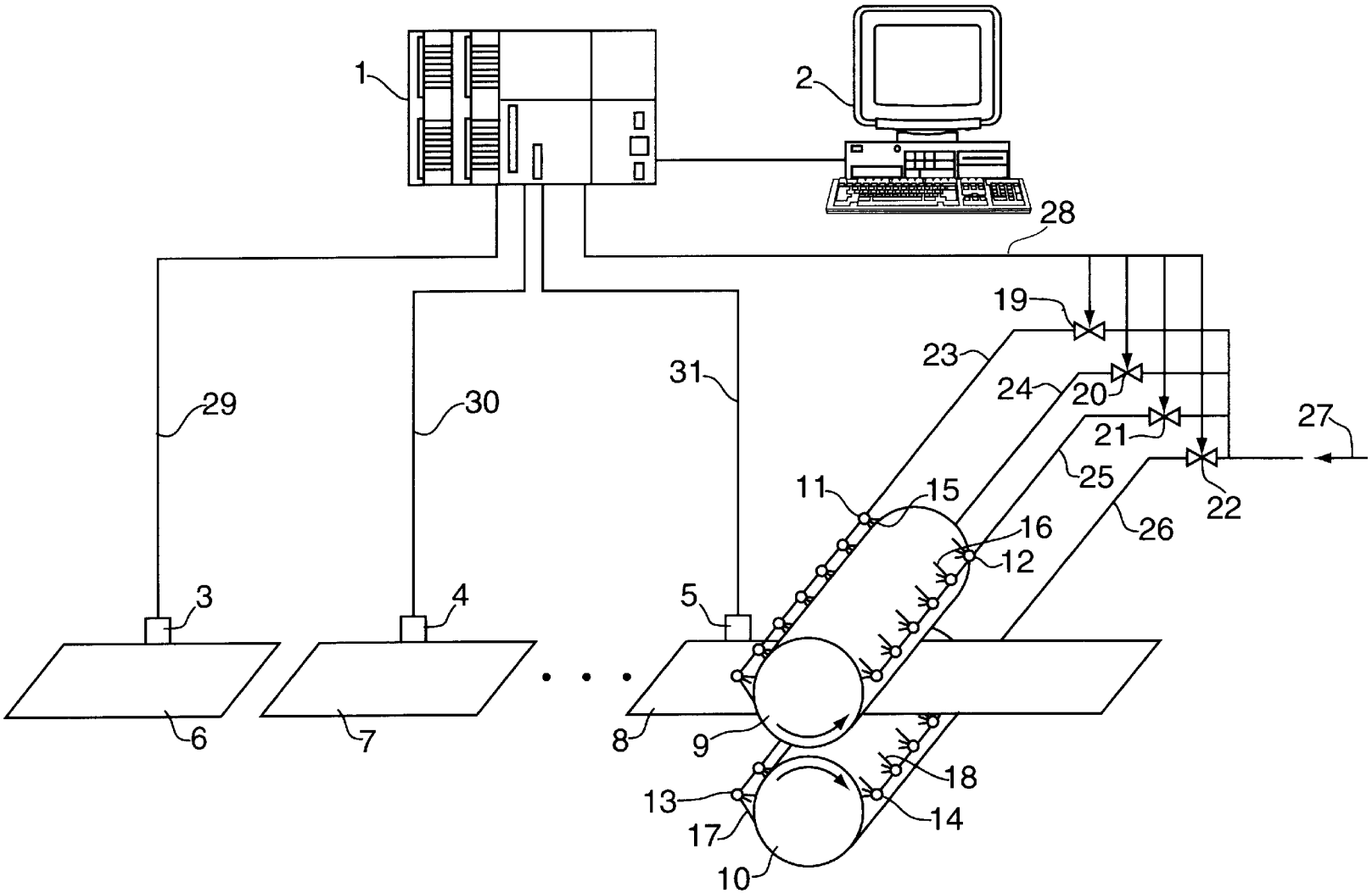
FIG. 1 schematically illustrates a device constructed according to the principles of the present invention for influencing the profile of a rolled strip.

FIG. 1 shows a device for influencing the profile of a rolled strip 8 in a roll stand by affecting the camber of rolls 9 and 10 in the roll stand. The thickness profile of rolled strip 8 is influenced by the load roll gap profile and thus the camber, i.e., the surface geometry of rolls 9 and 10. The camber of rolls 9 and 10 is in turn affected by their temperature profile. The variation of this temperature profile can be accomplished by heating or cooling the rolls along the longitudinal direction of the rolls 9 and 10. This process will be explained in terms of the application of coolant to the rolls 9 and 10.

The rolls are cooled by a cooling system having nozzle strips 11, 12, 13 and 14, feeder systems 23, 24, 25, 26, valves or valve blocks 19, 20, 21, 22 and a coolant inlet 27. A coolant 15, 16, 17, 18, which preferably is water, is discharged through the nozzles of nozzle strips 11, 12, 13, 14 and cools rolls 9 and 10. The nozzles of nozzle strips 11, 12, 13, 14 are advantageously organized either individually or in segments, and may apply different quantities of coolant to rolls 9 and 10. Thus, the nozzles are supplied with coolant 15, 16, 17, 18 either individually or in segments, through separate feeder lines of feeder systems 23, 24, 25, 26 whose coolant pressure is controlled by valve blocks 19, 20, 21, 22. The valve blocks are in turn controlled by a workstation 1 to which the valve blocks 19, 20, 21, 22 are connected over a data line 28. The workstation determines the required cooling of rolls 9 and 10 as a function of the roll stand parameters or rolled strip parameters such as the load time, the pause time between rolled strips 6, 7, 8, the roll separating force or the temperature of rolled strips 6, 7, 8. This information is received by workstation 1 either through sensors 3, 4, 5 that are connected to workstation 1 over appropriate data lines 29, 30, 31 or through a higher-level system or input terminal 2. The data connection between sensors and valve blocks on the one hand and workstation 1 on the other may be in the form of point-to-point connections or via a bus system.

According to one advantageous embodiment of the present invention, the required camber and thus the required degree of cooling for the rolls is calculated not only for the n-th rolled strip 8, but also for the subsequent rolled strips. The value for the required camber of an (I+1)th rolled strip 7 is entered into the calculation of the required camber of an I-th rolled strip 6.

Figure 2:
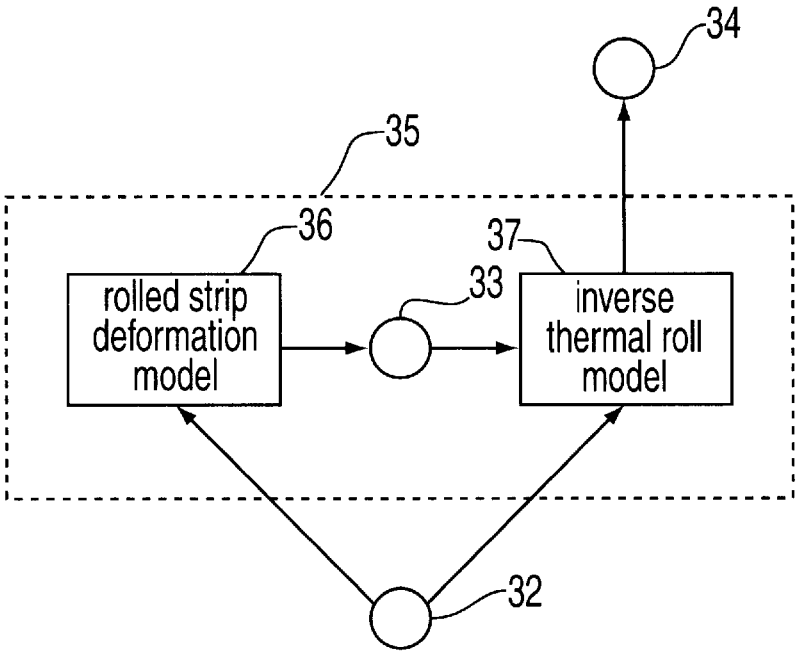
FIG. 2 shows the structure of a roll model utilized in this invention.

FIG. 2 shows the structure of a roll model 35 with which the required level of thermal influence 34 (i.e., heat transfer) is determined. By thermal influence, it is meant either both the required quantity of fluid (for heating or cooling), as well as the geometric flow pattern governing its application to the rolls (i.e. the pattern of fluid application) as a function of roll stand parameters or rolled strip parameters 32 (e.g., load time, pause time between two rolled strips, roll separating force or strip temperature). Initially, by using a rolled strip deformation model 36, the required camber 33 (e.g., the ideal camber) is determined as a function of the parameters of the roll stand as modeled by the rolled strip deformation model 36, or the parameters of the rolled strip as modeled by the rolled strip deformation model 36. Next, the required level of thermal influence 34 is calculated. In particular, the required quantity or a pattern of the coolant to be applied on the rolls (or heating the rolls) as a function of the required camber 33 and the roll stand parameters or rolled strip parameters 32 in an inverse thermal roll model 37 is determined. Inverse thermal roll model 37 can be either an inverted model for calculating the required level of thermal influence 34 as a function of the required camber 33 or a thermal roll model included in an iteration process to calculate the camber as a function of the required level of thermal influence 34 on the roll.

The roll model 35 can include an analytical model, a neural network and/or a combination of the analytical model and the neural network. The neural network may include a self-configuring neuronal network. The roll model 35 and/or parts of the roll model 35 can also be used to control the online processes when the neural network uses an on-line learning procedure.

Figure 3:
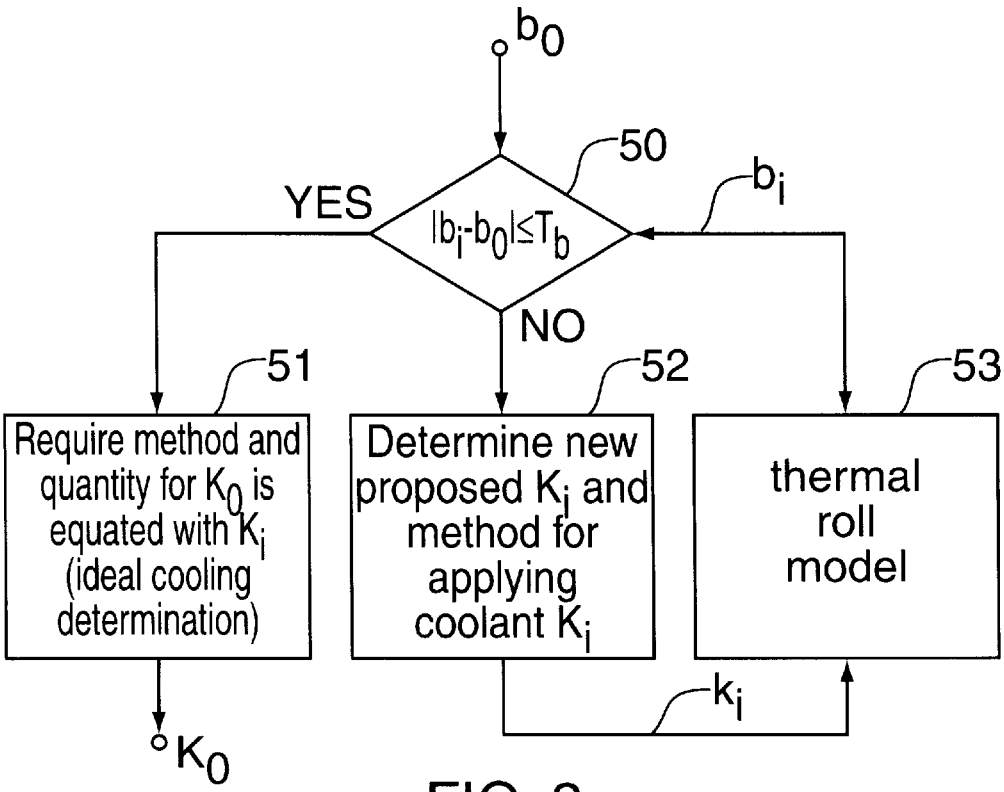
FIG. 3 presents a flow chart for iterative determination of the ideal quantity of coolant and application of the pattern of the coolant to the rolls using a thermal roll model according to the present invention.

FIG. 3 shows a flow chart for an iterative determination of an ideal quantity and the pattern of the coolant $k_0$ to be applied on the rolls using a thermal roll model 53 that determines the thermal camber $b_i$ of a roll as a function of the quantity and the pattern of the coolant $k_i$ to be applied on the rolls to cool the rolls. In the thermal roll model 53, a thermal camber $b_i$ of the cooled roll is determined from a given quantity and the pattern of the coolant $k_i$ on the rolls. The thermal camber $b_i$ of the roll is compared with the ideal camber $b_o$ of the roll in a comparator 50. Comparator 50 makes an inquiry as to whether $|b_i-b_o|\leqq T_b$, where $T_b$ is a preset tolerance value. If the absolute value of the difference between $b_i$ and $b_0$ is greater than the tolerance value $T_b$, function block 52 determines a new proposed quantity of coolant $k_i$ for as an improved quantity and the pattern of the coolant $k_i$ to be applied on the rolls. The initial value for iteration for the quantity and the pattern of the coolant $k_i$ on the rolls is a proven empirical value representing a long-term average. If the absolute value of the difference between $b_i$ and $b_0$ is equal to or less than the tolerance value $T_b$, the required quantity of coolant $k_0$ and the pattern of the coolant $k_0$ to be applied to the rolls is equated with the quantity and the pattern of the coolant $k_i$ with an ideal cooling determination 51. The required quantity and method of application of coolant $k_0$ is the command variable or reference variable for the cooling system of the rolls and a control thereof. The values $k_i$, $k_0$, $b_i$, $b_0$ and $T_b$ are not scalar quantities but column matrices with one or more values. For example, the column matrix of the coolant $k_0$ contains various command variables or reference variables of the cooling systems for the individual cooling segments for cooling a roll.

Iteration process is applied by an equivalent procedure if the roll is heated instead of cooled. In this case $k_0$ is required quantity (or reference quantity) for the heating system for heating the roll and $k_i$ relates to an ideal quantity for heating the roll.

Figure 4:
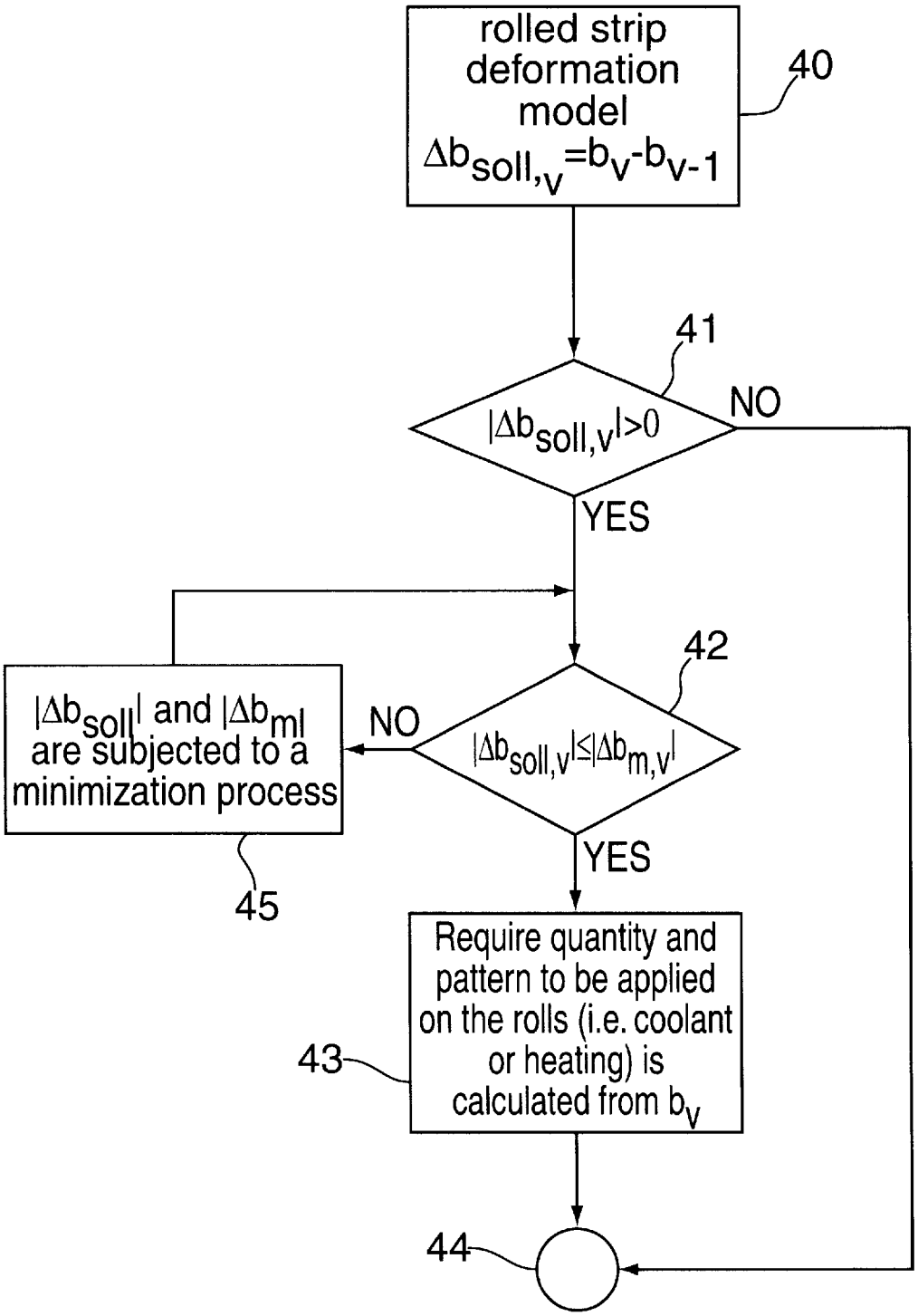
FIG. 4 shows a calculation of the required level of thermal influence taking into account a limited thermal deformability of the rolls.

FIG. 4 illustrates the procedure for calculating the required level of thermal influence, e.g., in the form of a required quantity and the pattern of the coolant (or the heating fluid) to be applied on the rolls, taking into account a limited thermal deformability of the rolls over time. If the requirement regarding the change in the ideal thermal camber $|\Delta b_{soll}|$ over time is greater than the possible rate of adjustment of thermal camber $|\Delta b_m|$, then the difference between the required camber $|\Delta b_{soll}|$ and the possible rate of adjustment of thermal camber $|\Delta b_m|$ is distributed among several rolled strips so that the difference between the two variables is minimal. The procedure is as follows:

First, using a rolled strip deformation model 40, the thermal camber for the v-th rolled strip and the desired difference between the thermal cambers of two rolled strips $\Delta b_{soll,\ v}$ vis determined with $\Delta b_{soll,\ v}=b_v-b_{v-1}$ where $b_v$ is the desired camber for a roll stand for rolling the v-th rolled strip and $b_{v-1}$ is the thermal camber for the same roll stand but for rolling the next rolled strip, i.e., the (v−1)th rolled strip. This is followed by an inquiry 41 whether $|\Delta b_{soll,\ v}|>0$. If $|\Delta b_{soll,\ v}|$ is not greater than zero, any change in the level of thermal influence is not necessary. However, if $|\Delta b_{soll,\ v}|$ is greater than zero, an inquiry 42 is made regarding whether $|\Delta b_{soll,\ v}|\leqq|\Delta b_{m,\ v}|$. If this condition is met, the required level of thermal influence 44, i.e., the required quantity and the pattern of the coolant (or heating fluid) to be applied on the rolls is calculated in another step 43 from $b_v$, i.e., the required thermal camber for the v-th rolled strip. However, if this condition is not met, the difference between the desired change in thermal camber $|\Delta b_{soll}|$ and the possible rate of change in thermal camber $|\Delta b_m|$ is subjected to a minimization process 45. In minimization process 45, a new setpoint for the change in thermal camber $|\Delta b_{soll,\ v,\ new}|$ is formed, e.g., by minimizing $\Sigma(|\Delta b_{soll,\ v}|-|\Delta b_{soll,\ v,\ new}|)^2$ over rolled strips equating at the same time $\Delta b_{soll,\ v}$ and $\Delta b_{soll,\ v,\ new}$, i.e., $\Delta b_{soll,\ v}=\Delta b_{soll,\ v,\ new}$. The new $\Delta b_{soll}$ is then subjected again to inquiry 42.

This prediction is flexible and is based on the type of strips to be rolled. If similar strips are rolled, no prediction is necessary. However, if a change in the type of strip is planned, a prediction is made up to the new type of strip and possibly beyond.

If the required thermal camber cannot be set, the difference (shown in the flow chart illustrated in FIG. 4) is distributed among several strips. As a result, the thermal camber for some strips is intentionally left unoptimized. The deviation from the desired thermal camber is kept low, however, so that it varies within certain tolerance limits and there is no inadmissible reduction in the desired roll quality and/or the deviation from the desired thermal camber is maintained at a low level so that it can be corrected by other measures (e.g., mechanical measures).

What is claimed is:

1. A method for influencing quality parameters of rolled strips in a roll stand having rolls, comprising the steps of:

controlling at least one of a camber of the rolls and a surface geometry of the rolls in a longitudinal direction of the rolls by thermally modifying a temperature of one of the rolls and surfaces of the rolls in the longitudinal direction;

when a required change in the camber exceeds a possible change in the camber, determining a difference between the required change and the possible change;

distributing the difference among a predetermined number of the rolled strips to minimize a deviation of the required change in the camber and of the possible change in the camber for the rolled strips;

providing a tolerance range for the strips by predicting if the required change in the camber of at least preceding one of the strips, with respect to a subsequent one of the strips, has occurred; and deviating from an optimal change of the camber for an individual one of the strips if values of the camber of the individual one of the strips are within the tolerance range.

2. The method according to claim 1, wherein the camber of the rolls is controlled by variably cooling the rolls in the longitudinal direction of the rolls applying a coolant to the rolls.

3. The method according to claim 1, wherein the camber of the rolls is controlled using a cooling system, the cooling system being segmentally controllable along the longitudinal direction of the rolls.

4. The method according to claim 1, wherein the surface geometry of the rolls is cooled by applying a coolant to the rolls, the coolant including water without lubricant properties.

5. The method according to claim 1, wherein the camber of the rolls is controlled by heating at least one of the rolls and the surfaces of the rolls along the longitudinal direction of the rolls.

6. The method according to claim 5, wherein the camber of the rolls is controlled by heating the rolls that are variable along the longitudinal direction of the rolls using a heating system, the heating system segmentally controllable along the longitudinal direction of the rolls.

7. The method according to claim 1, wherein the camber of the rolls is controlled by one of varying a quantity of a coolant applied to the rolls and by varying a pattern of the coolant to be applied to the rolls for presetting the roll stand to be performed between a processing of two of the rolled strips.

8. The method according to claim 7, wherein the camber of the rolls is controlled on-line to pace with a throughput of the rolled strips.

9. The method according to claim 1, further comprising the steps of:

determining a quantity of a coolant; and applying a pattern of the coolant to the rolls as a function of the properties of the predetermined number of rolled strips especially at least one of:

a load time of the roll stand, a pause time between two of the rolled strips, a roll-separating force, and a temperature of the strip.

10. The method according to claim 9, wherein the pattern of the coolant is applied to the rolls as a further function of additional variables.

11. The method according to claim 9, wherein the pattern of the coolant is applied to the rolls using a roll model, the roll model maintaining a correlation between the quantity of the coolant and the pattern of the coolant to be applied to the rolls and further quality parameters of the rolled strips.

12. The method according to claim 11, wherein the roll model includes an analytical model.

13. The method according to claim 11, wherein the roll model includes a neural network.

14. The method according to claim 13, further comprising the step of:

controlling on-line processes using one of the roll model and parts of the roll model when the neural network uses an on-line learning procedure.

15. A method for influencing quality parameters of rolled strips in a roll stand having rolls, comprising the steps of:

controlling at least one of a camber of the rolls and a surface geometry of the rolls in a longitudinal direction of the rolls by thermally modifying a temperature of one of the rolls and surfaces of the rolls in the longitudinal direction;

when a required change in the camber exceeds a possible change in the camber, determining a difference between the required change and the possible change;

distributing the difference among a predetermined number of the rolled strips to minimize a deviation of the required change in the camber and of the possible change in the camber for the rolled strips;

determining a quantity of a coolant; and applying a pattern of the coolant to the rolls as a function of the properties of the predetermined number of rolled strips especially at least one of:

a load time of the roll stand, a pause time between two of the rolled strips, a roll-separating force, and a temperature of the strip wherein the pattern of the coolant is applied to the rolls using a roll model, the roll model maintaining a correlation between the quantity of the coolant and the pattern of the coolant to be applied to the rolls and further quality parameters of the rolled strips, wherein the roll model includes a rolled strip deformation model and an inverse thermal roll model, wherein the rolled strip deformation model correlates between an ideal roll camber and further quality parameters as a function of roll stand parameters and further rolled strip parameters, and wherein the inverse thermal roll model correlates between a command variable for cooling the rolls and the camber of the rolls as a function of the roll stand parameters and the rolled strip parameters.

16. The method according to claim 15, wherein the inverse thermal roll model includes a further thermal roll model, the further thermal roll model determining the camber of the rolls as a function of one of the roll stand parameters and the rolled strip parameters, and a level of thermal influence of the rolls, wherein the step of determining the quantity of the coolant is repeated as a function of a predetermined camber of the rolls using a thermal roll model, and wherein the step of determining the quantity of the coolant is repeated until a difference between the camber determined with the thermal roll model and the predetermined camber is smaller than a predefined tolerance value.

17. The method according to claim 15, wherein the quantity of the coolant and the pattern of the coolant to be applied to the rolls are determined as a function of a predetermined camber of the rolls using an inverted thermal roll model, the inverted thermal roll model correlating between the command variable, the predetermined camber of the rolls and one of the roll stand and the rolled strip parameters.

18. The method according to claim 6, wherein the heating system heats the rolls to a predetermined operating temperature.

19. The method according to claim 11, wherein the further quality parameters includes one of a profile parameter of the rolled strips and a flatness parameter of the rolled strips.

20. The method according to claim 13, wherein the neural network includes a self-configuring neuronal network.

21. The method according to claim 15, wherein the further quality parameters includes one of a profile parameter of the rolled strips and a flatness parameter of the rolled strips.

22. The method according to claim 16, wherein the rolled strip parameters include at least one of a load time, a pause time between two of the rolled strips and a roll-separating force.

23. The method according to claim 1, further comprising the step of:

heating the rolls as a function of at least one of:

a load time of the roll stand, a pause time between two of the rolled strips, a roll-separating force, and a temperature of the strip.

24. The method according to claim 11, wherein the roll model includes a combination of a analytical model and a neural network.

25. A method of using a roll stand having axially extending rolls to control the flatness of a rolled strip by thermally controlling the camber of the rolls having strips, comprising the steps of:

determining a desired degree of the camber of the rolls;

determining a necessary change to the thermally controlled camber of the rolls for achieving the desired degree;

determining a possible change at which the thermally controlled camber of the rolls can be achieved;

comparing a difference between the possible change in the camber with the necessary change in the camber via an application of a thermal fluid to the rolls;

distributing the difference among a plurality of rolled strips;

providing a tolerance range for the strips by predicting if the necessary change in the camber of at least preceding one of the strips, with respect to a subsequent one of the strips, has occurred; and deviating from an optimal change of the camber for an individual one of the strips if values of the camber of the individual one of the strips are within the tolerance range.

* * * * *